United States Patent [19]

Teltscher

[11] Patent Number: 4,750,521

[45] Date of Patent: Jun. 14, 1988

[54] MULTIPLE CONNECTION VALVE

[75] Inventor: Rainer Teltscher, Waagkirchen, Fed. Rep. of Germany

[73] Assignee: Concordia Fluidtechnik GmbH, Stuttgart, Fed. Rep. of Germany

[21] Appl. No.: 31,778

[22] Filed: Mar. 30, 1987

[30] Foreign Application Priority Data

Apr. 23, 1986 [DE] Fed. Rep. of Germany ..... 3613746

[51] Int. Cl.[4] ..... F15B 13/043

[52] U.S. Cl. ..... 137/625.66; 137/625.26; 137/625.27; 137/625.64

[58] Field of Search ..... 137/625.26, 625.27, 137/625.64, 625.66

[56] References Cited

U.S. PATENT DOCUMENTS

| | | | |
|---|---|---|---|
| 2,725,077 | 11/1955 | Nicholl | 137/625.64 |
| 2,998,026 | 8/1961 | Becker | 137/625.64 |
| 3,269,417 | 8/1966 | Lansky et al. | 137/625.64 |
| 3,283,784 | 11/1966 | Ruchser | 137/625.64 |
| 3,425,449 | 2/1969 | Leibfritz | 137/625.64 |
| 3,523,555 | 8/1970 | Padula | 137/625.64 |
| 3,608,587 | 9/1971 | Zbell | 137/625.66 |
| 3,771,565 | 11/1973 | Padula | 137/625.64 |
| 4,067,357 | 1/1978 | Ruchser | 137/625.66 X |
| 4,245,671 | 1/1981 | Kosugui | 137/625.64 |

FOREIGN PATENT DOCUMENTS

| | | | |
|---|---|---|---|
| 129665 | 1/1985 | European Pat. Off. | 137/625.27 |
| 1047556 | 12/1958 | Fed. Rep. of Germany | 137/625.27 |
| 1247786 | 8/1967 | Fed. Rep. of Germany | 137/625.64 |
| 1500089 | 5/1970 | Fed. Rep. of Germany | 137/625.64 |
| 227211 | 9/1985 | German Democratic Rep. | 137/625.66 |

*Primary Examiner*—Gerald A. Michalsky
*Attorney, Agent, or Firm*—Learman & McCulloch

[57] ABSTRACT

The invention relates to a 5/2-way valve in which the two control pistons with their inner end faces define the housing chambers which are provided with the connections for the removal of the pressure medium and are capable of limited free movement in an axial direction relative to the piston rod. Such a valve is distinguished by a particularly small size and a simple construction.

9 Claims, 4 Drawing Sheets

MULTIPLE CONNECTION VALVE

The invention relates to a valve containing five connections and two switch positions, known in the art as a so-called "5/2-way valve".

BACKGROUND OF THE INVENTION

In valves of this type the effective surface of the control piston must be greater than the effective surface of the sealing element which in one switch position breaks the connection between the consuming device which is supplied with pressure medium and the appertaining connection for removal of the pressure medium. Only when the control piston is supplied with pressure medium can it move the piston rod into the other switch position.

However, this necessary dimensioning of the control piston results in a problem if an instantaneous excess pressure occurs as a result of external influences (for instance simultaneous venting of air from a plurality of valves connected to a common exhaust air pipe) in the housing chamber which connects the consuming device from which air has just been vented to the appertaining connection for removal of the pressure medium. If this excess pressure were to act on the inner end face of the adjacent control piston this would cause unintentional actuation of the valve. i.e. incorrect actuation.

In order to avoid this disadvantage, in the previously known valves of the type set out in the introduction two sealing and pressure-equalising pistons, each bearing sealing elements which co-operate with a bushing pressed into the valve housing, are arranged between the control piston and the chambers of the housing provided with the connections for removal of the pressure medium.

These two additional sealing or pressure-equalising pistons have in particular the undesirable effect of increasing the length of the valve. There are further disadvantages in the increase in the number of individual parts of the valve, the complication of the assembly and the shortening of the working life.

SUMMARY OF THE INVENTION

The object of the invention, therefore, is to construct a valve of the type set out in the introduction in such a way that the size, and particularly the length, is substantially reduced. The design, while maintaining a reliable function, is considerably simplified, assembly made easier and the working life is lengthened.

THE DRAWINGS

DETAILED DESCRIPTION

Figure 1:
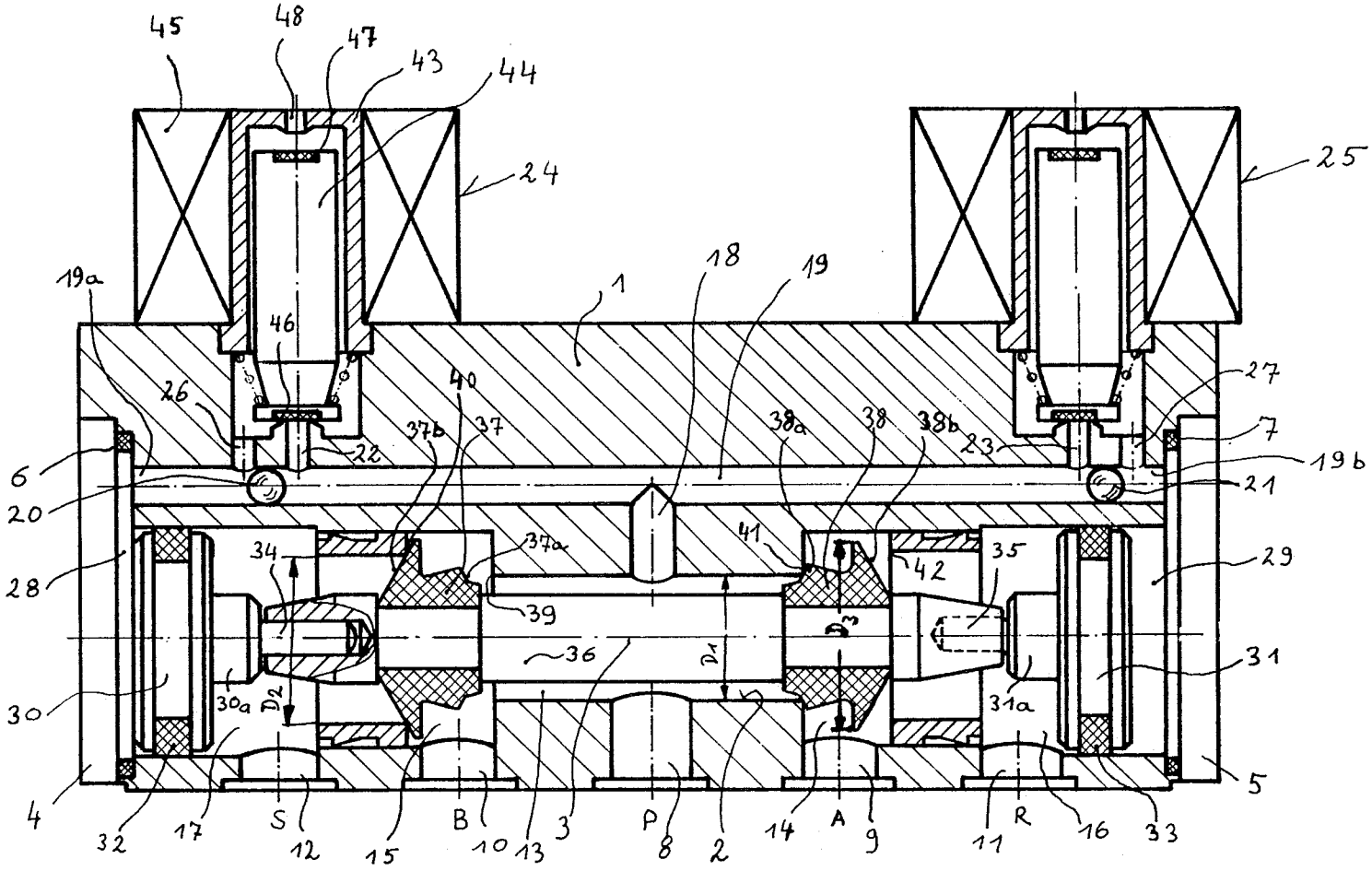
FIG. 1 shows a cross-section through a first embodiment of the invention (bistable variant)

The 5/2-valve illustrated in FIG. 1 in a bistable construction contains in a housing 1 a through bore 2 (with an axis 3) which is closed at its ends by housing covers 4 and 5 with sealing elements 6 and 7 respectively interposed.

Five transverse bores 8, 9, 10, 11 and 12 open into the bore 2 and form the following connections:

The transverse bore 8 forms a pressure medium connection P, the transverse bores 9 and 10 form two connections A and B respectively each being for delivery of the pressure medium to a consuming device. The transverse bores 11 and 12 form two connections R and S respectively for removal of the pressure medium from the two consuming devices (air-venting connections).

The regions of the bore 2 into which the transverse bores 8 to 12 open form a central chamber 13, two inboard chambers 14 and 15, and two outboard chambers 16 and 17.

The central chamber 13 is connected via a further transverse bore 18 to a channel 19 running parallel to the bore 2 and closed near its ends by balls 20 and 21. Bores 22, 23 connect the channel 19 to servo elements 24 and 25 respectively which are connected to the outer end surfaces of control pistons 30, 31 accommodated in the outboard chambers via bores 26 and 27 respectively, the outer regions 19*a*, 19*b* of the channel 19 and chambers 28 and 29 respectively.

The control pistons 30, 31 are provided on their periphery with a sealing element 32, 33 and have an attachment 30*a*, 31*a* on their inner end faces.

The control pistons 30, 31 are guided on a piston rod 36 so as to be slidably movable and axially spaced via guide pins 34, 35 which co-operate with a guide bore. The guide pins 34, 35 can either be firmly connected to the piston rod 36 and engage in guide bores in the control pistons 30, 31 or the relationship can be reversed. Thus the control pistons 30, 31 are freely movable relative to the piston rod 36 between an outer stop position in which the control pistons 30, 31 rest on the housing covers 4 or 5 and an inner position in which the control pistons 30, 31 are in force-locking engagement with the piston rod 36 (whilst the attachment 30*a* or 31*a* rests on the adjacent end face of the piston rod 36).

The piston rod 36 bears two sealing parts 37, 38 which are of identical construction and arranged in mirror image, and of these the sealing part 37 will be described in greater detail below. It consists of two sealing elements 37*a*, 37*b* which are constructed so as to be integral with one another. Each cooperates with a valve seat 39 and 40 respectively. In a corresponding manner the sealing part 38 consists of sealing elements 38*a*, 38*b* which co-operate with valve seats 41, 42.

The two servo elements 24, 25 which are of similar construction contain in a housing 43 a movable push rod 44 which can be actuated by a coil 45. In one (lower) end position the push rod 44 closes the connection between the bores 22 and 46 with a sealing element 46. In the other (upper) position the push rod 44 closes an air-venting bore 48 with a sealing element 47. The same applies to the servo element 25.

The way in which the valve according to the invention functions is as follows. It is assumed that compressed air is used as the pressure medium:

In the position shown in FIG. 1 compressed air enters the chamber 15 from the connection P and thus reaches the connection B of one consuming device. Since air has been vented from the chamber 17, the sealing element 37*b* is pressed onto the valve seat 40. The sealing element 37*b* which is constructed as a flexible diaphragm seal curves through to the chamber 17 and draws the sealing element 38*a* onto its seat 41 over the piston rod 36. Since the effective diameter $D_2$ of the sealing element 37*b* is greater than the effective diameter $D_1$ of the sealing element 38*a*, the valve is automatically held in this position because of the difference in cross-section occurring here.

If the left-hand servo 24 element is actuated in a pulsing manner the push rod 44 moves upwards, closes the air-venting bore 48 and forms a connection between the pressure medium connection P and the chamber 28, adjacent to the left-hand end face of the control piston 30, via the bores 22, 26. The control piston then moves the piston rod 36 into its right-hand end position. In this way the sealng element **37*b* is lifted from the valve seat 40 and the sealing element 37*a* is pressed onto the valve seat 39, so that the consuming device which was previously supplied with air via the connection B now has air vented from it via the connection S. The sealing element 38*a* is lifted from the valve seat 41 and the sealing element 38*b* is pressed onto the valve seat 42**. The consuming device (connection A) which previously had air vented from it via the connection R now receives compressed air from the connection P.

If the valve is then to be moved out of the switch position last referred to above (right-hand position) back into the left-hand switch position shown in FIG. 1, then the servo element 25 is actuated in a pulsing manner so that compressed air is delivered to the right-hand control piston 31 via the chamber 29.

Let it now be assumed that the valve is in the switch position illustrated in FIG. 1 and that for some extraneous reason (for example because of the simultaneous venting of air from a plurality of valves connected to one common exhaust air pipe) a pressure peak occurs in the chamber 16. If the control piston 31 were firmly connected to the piston rod 36 there would then be a danger that the control piston 31 would be moved towards the right by the resulting pressure surge and thus incorrect actuation of the valve would take place. However, the control piston 31 of the valve according to the invention is capable of limited axial movement relative to the piston rod 36. In this hypothetical situation it can move towards the right in the event of a pressure surge in the chamber 16. In this way incorrect actuation of the valve is reliably avoided.

To aid understanding it should be noted that the problem described above of incorrect actuation of the valve by a pressure surge in the housing chamber from which air has been vented cannot be solved by giving the control piston 31 the same effective diameter as the sealing element **38*a* which is pressed against the valve seat 41 (diameter $D_1$) since the diameter of the control piston 31 must be greater than $D_2$ in order to be able to control the valve. It is for this reason that additional sealing or pressure-equalising pistons are provided between the control pistons 30, 31 and the chambers 16, 17** in the known valves described in the introduction.

In order to avoid a state of suspension of the system during switching over of the valve, the symmetry of the chambers 14 and 15 is destroyed by giving the sealing elements **37*b*, 38*b* a somewhat different diameter $D_3$ or constructing the housing in the chambers 14 and 15** with a different diameter.

The valve according to FIG. 1 is distinguished by its very compact construction, particularly its short length. In addition, by contrast with the known constructions it has a simplified design and a reduced number of individual parts. It can be assembled very simply and has a longer working life. The embodiment illustrated in FIG. 1 is a bistable valve. Thus it is guided into one or the other switch position by a pulse delivered to the servo element 24 or 25.

Figure 2:
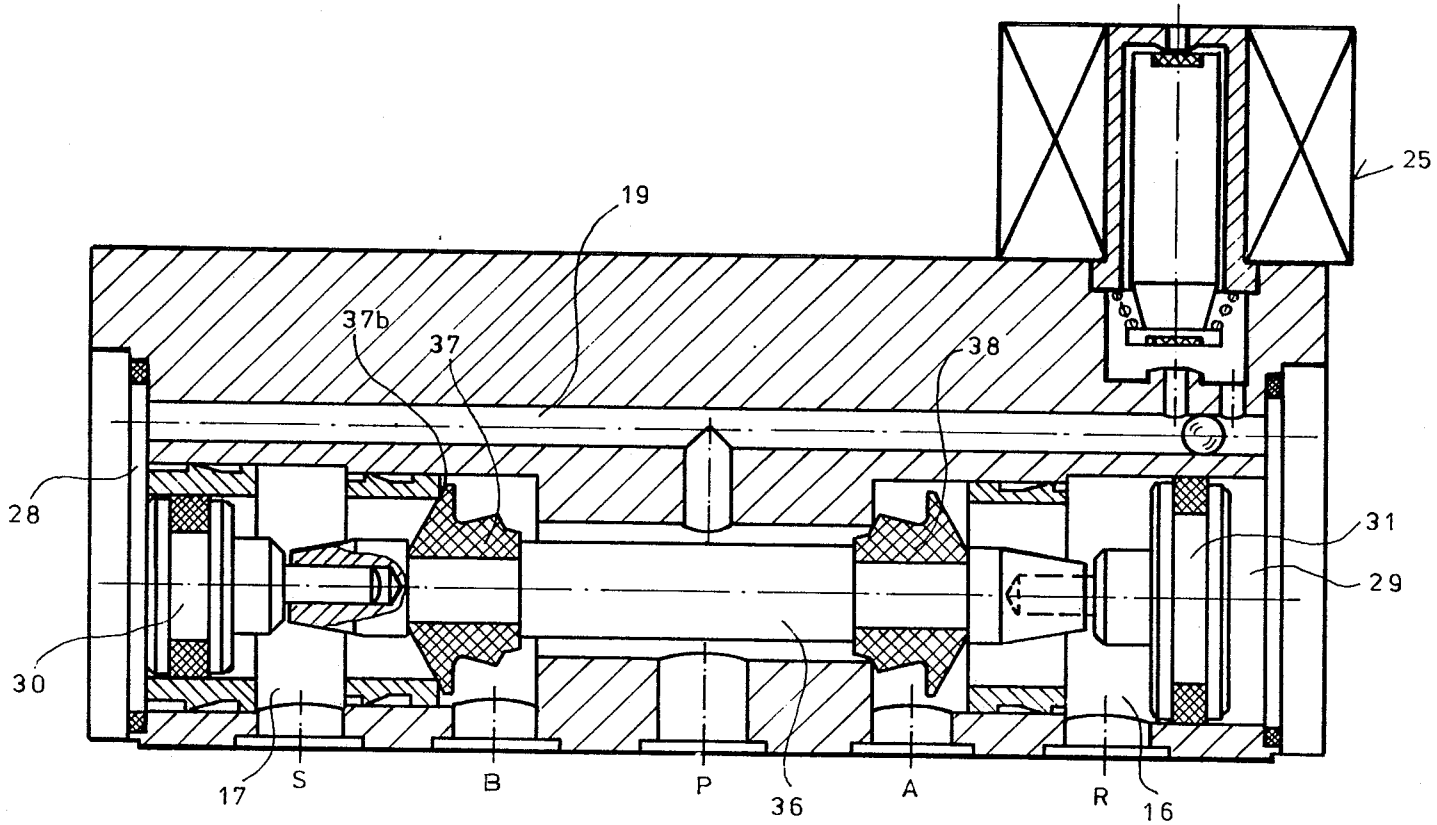
FIG. 2 shows a section through a valve according to the invention in a monostable construction.

By contrast FIG. 2 shows a monostable variant with only one single servo element 25. Here the channel 19 is connected directly to the chamber 28 on the left-hand end face of the control piston 30. The diameter of the control piston 30 is chosen so as to be smaller than that of the control piston 31. Otherwise the embodiment according to FIG. 2 corresponds to the valve acording to FIG. 1. Accordingly the same parts are designated by the same reference numerals.

The valve according to FIG. 2 functions as follows:

FIG. 2 shows the valve in the switch position which is obtained when the servo element 25 is actuated by a signal. The right-hand control piston 31 to which the compressed air was delivered from the connection P via the channel 19, the servo element 25 and the chamber 29 has pushed the piston rod 36 towards the left against the effect of the smaller control piston 30.

If no control signal is delivered to the servo element 25 the latter vents air from the chamber 29. Then the left-hand control piston 30 presses the piston rod with the sealing parts 37, 38 into the right-hand end position. The valve thus returns into the right-hand switch position in the absence of a control signal and remains in this position until a new control signal arrives.

In this embodiment also the control pistons 30, 31 with their inner end faces define the housing chambers 16, 17 which are provided with the connections R, S for removing the pressure medium. Just as in the embodiment according to FIG. 1, in the variant according to the FIG. 2 the two control pistons 30, 31 are capable of limited free movement in an axial direction relative to the piston rod 36. If in the switch position illustrated in FIG. 2 a pressure peak occurs in the chamber 16 as a result of an external influence, then the control piston 31 can move towards the right without the piston rod 36 moving with it. Incorrect actuation of the valve is therefore avoided.

In the embodiments according to FIGS. 1 and 2 the supply of pressure medium is not switched over between the two consuming devices without overlap; thus in an intermediate phase during the switching one consuming device is still having air vented from it while the other consuming device has already had air vented from it.

Figure 3:
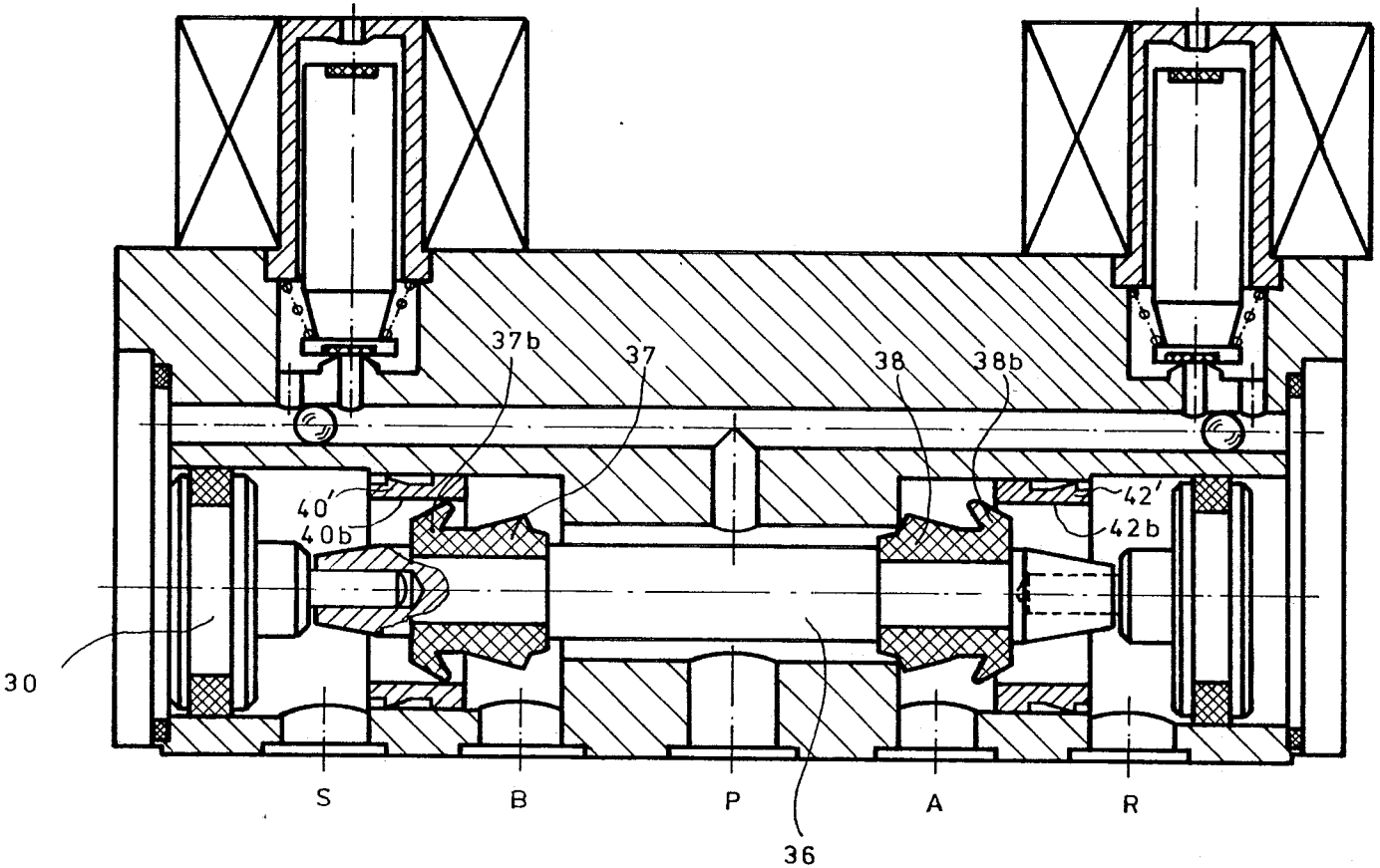
FIGS. 3 and 4 show variants with switchng partially or completely free of overlap.

If, by contrast, switching without overlap is required, then the construction according to FIG. 3 can be chosen. Up to the construction of the sealing parts 37, 38 it corresponds to the construction according to FIG. 1. Here the sealing element **37*b*, 38*b* are not constructed (as in FIGS. 1 and 2) as seat seals but as slide seals and co-operate with the inner periphery 40*b*, 42*b* of a bushing 40' or 42' respectively. Thus the sealing elements 37*b*, 38*b* form lip ring seals which seal the piston rod 36** over a certain path during the axial movement.

If the piston rod 36 is moved for example out of the position illustrated in FIG. 3 towards the right by the control piston 30, then first of all the sealing element **38*b* comes into sealing contact with the bushing 42' and thus separates the connection A from the connection R before the sealing element 37*b* then emerges from the bushing 40' and produces a connection between the connections 8 and 5. In this way the air-venting connections R and 5** can be switched over without overlap so that even during switching at least one of the two consuming devices is always supplied with compressed air.

Figure 4:
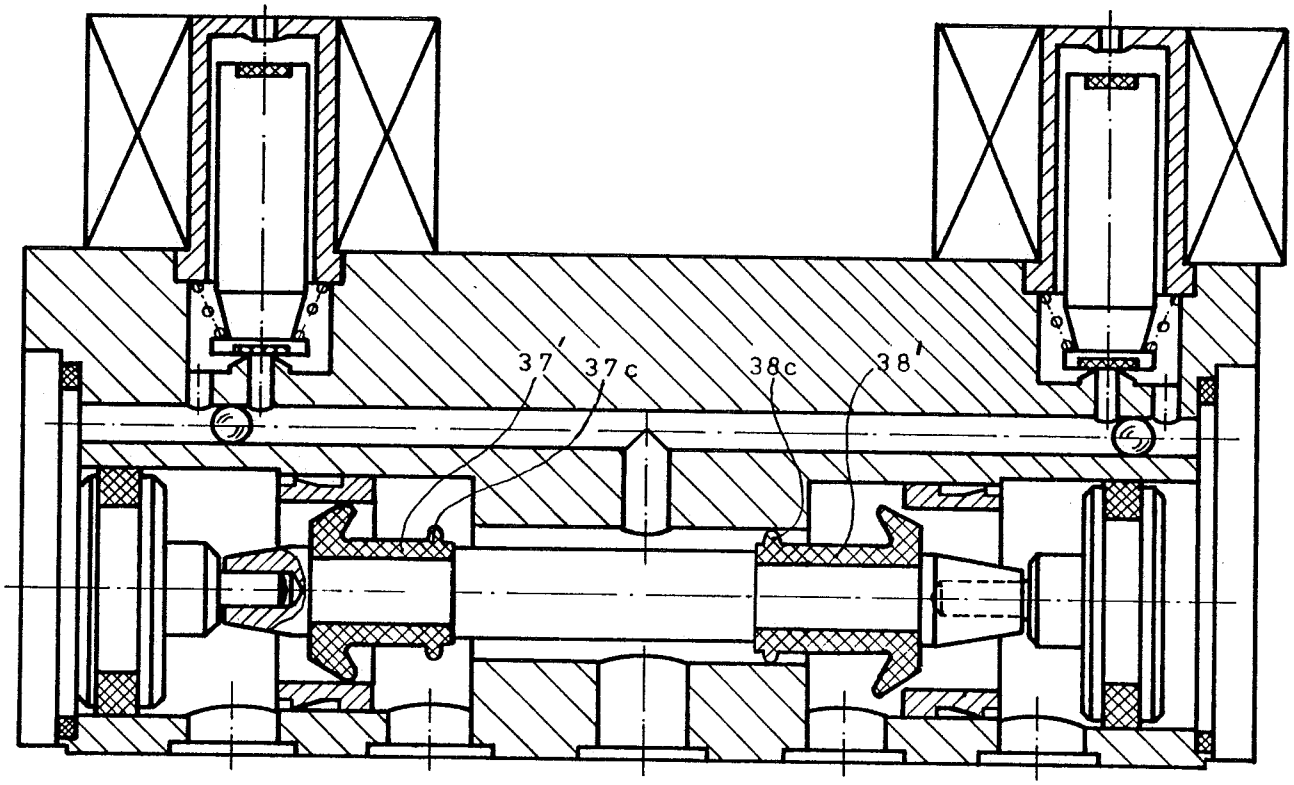

The construction according to FIG. 4 corresponds largely to that of FIG. 3. However, the sealing parts here are constructed so that slide seals **37*c*, 38*c* are provided instead of the sealing elements 37***a*, 38*a* which are constructed as seat seals. Thus during switching the slide seal 38*c* only opens when the slide seal 37*c* has already closed (and vice versa).

What is claimed is:

1. In a multiple connection valve including a valve housing having a pressure medium connection, two connections each serving for delivery of the pressure medium to a consuming device, and two connections for removal of the pressure medium from the two consuming devices; a piston rod member movable between two switch positions in the valve housing; spaced apart sealing elements fixed to the piston rod member and which, in a first switch position of the piston rod member, connect a first consuming device connection to the pressure medium connection and connect the second consuming device connection to the associated connection for removal of the pressure medium, and in a second switch position of the piston rod member connect the second consuming device connection to the pressure medium connection and connect the first consuming device connecting to the associated connection for removal of the pressure medium; and two control piston members for moving the piston rod member into one or the other of said switch positions, the improvement wherein said valve housing has an outboard chamber therein associated with each respective connection for the removal of the pressure medium; means mounting each of said piston members in a respective one of said outboard chambers for axial sliding movements, each of said piston members having an inner face defining one end wall of the respective chamber and being subjected to the pressures within said chamber and the pressure medium removal connection associated therewith, and means guiding said piston members on opposite ends of said piston rod member for coaxial limited movement relative to said piston rod member in each of two opposite directions for positive actuation of each of said piston members inward and limited free relative movement outward relative to said piston rod member in response to an extraneous pressure peak through the associated pressure removal connection to avoid unintentional valve actuation.

2. A valve according to claim 1 including guiding means connected to each of said piston members for guiding it during its movements.

3. A valve according to claim 2 wherein said guiding means comprises a pin on one of said members and a guide bore in the other of said members so that each piston member is slideably movable in an axial direction and freely movable relative to the piston rod member between an outer stop position and an inner position in which it is in engagement with the piston rod member.

4. A valve according to claim 1 including an inboard chamber adjacent and in communication with each of said outboard chambers, wherein each of the inboard chambers accommodates a pair of said sealing elements, and wherein sealing surfaces are provided within said housing whereby the first sealing element of each pair controls the connection of the respective inboard chamber to the pressure medium connection and the second sealing element of each pair controls the connection of the respective outboard chamber to the appertaining connection for the removal of the pressure medium.

5. A valve according to claim 4 wherein the first and second sealing elements of each pair of sealing elements are of integral construction.

6. A valve according to claim 4 wherein the second sealing element has an effective diameter greater than that of the first sealing element.

7. A valve according to claim 4 wherein the two sealing elements are constructed as seat seals.

8. A valve according to claim 4 wherein the first sealing element is constructed as a seat seal and the second sealing element is constructed as a slide seal.

9. A valve according to claim 4 wherein both sealing elements are constructed as slide seals.

* * * * *